US005295334A

United States Patent [19]

Haraden

[11] Patent Number: 5,295,334

[45] Date of Patent: Mar. 22, 1994

[54] SASH SENSOR BASE PLATE ASSEMBLY

[75] Inventor: William B. Haraden, McHenry, Ill.

[73] Assignee: Landis & Gyr Powers, Inc., Buffalo Grove, Ill.

[21] Appl. No.: 760,757

[22] Filed: Sep. 16, 1991

[51] Int. Cl.[5] ..... E05D 15/06; B08B 15/02

[52] U.S. Cl. ..... 52/1; 52/204.1; 52/729; 49/413; 454/59

[58] Field of Search ..... 52/1, 207, 729, 241, 52/710, 204; 49/413; 98/115.3; 454/59

[56] References Cited

U.S. PATENT DOCUMENTS

| | | | |
|---|---|---|---|
| 2,455,462 | 12/1948 | Bader et al. | 52/207 |
| 4,287,698 | 9/1981 | Baus | 52/241 |
| 4,398,373 | 8/1983 | Mancuso | 52/207 |
| 4,803,809 | 2/1989 | Takemura | 52/207 |

*Primary Examiner*—Michael Safavi
*Attorney, Agent, or Firm*—Welsh & Katz, Ltd.

[57] ABSTRACT

An apparatus for mounting a device for determining the position of a sliding sash door in a laboratory fume hood in the track of the sash door. This apparatus securely and permanently mounts the sensing means in the track even after exposure to corrosive and noxious chemicals such as MEK. This apparatus is thin enough to not to interfere with the operation of the sash door yet rigid enough to protect the sensing means. The apparatus includes a PVC base having a generally "I" shaped cross section with two recesses formed by two end portions and a middle portion of the base. The sensing means is located in one of these recesses and is secured therein by a first adhesive means. The PVC base and sensing means are attached to the track of the fume hood by a second adhesive means located in the other recess in the base. Both adhesive means are comprised of a high performance acrylic adhesive which is splash resistant to MEK. The second adhesive means also includes a closed cell foam compressible material so that there will be secure adhesion even to a rough or uneven track surface.

2 Claims, 1 Drawing Sheet

SASH SENSOR BASE PLATE ASSEMBLY

CROSS REFERENCE TO RELATED APPLICATIONS

| | |
|---|---|
| 1. Title: | Apparatus for Controlling the Ventilation of Laboratory Fume Hoods |
| Inventors: | Osman Ahmed, Steve Bradley, Steve Fritsche and Steve Jacob |
| Ser. No.: | 590,195 |
| 2. Title: | A System for Controlling the Differential Pressure of a Room Having Laboratory Fume Hoods |
| Inventors: | Osman Ahmed and Steve Bradley |
| Ser. No.: | 589,931 |
| 3. Title: | A Method and Apparatus for Determining the Uncovered Size of an Opening Adapted to be Covered by Multiple Moveable Doors |
| Inventors: | Osman Ahmed, Steve Bradley and Steve Fritsche |
| Ser. No.: | 590,194 |
| 4. Title: | Laboratory Fume Hood Control Apparatus Having Improved Safety Considerations |
| Inventor: | Osman Ahmed |
| Ser. No.: | 589,952 |
| 5. Title: | Apparatus For Determining The Position of a Moveable Structure Along a Track |
| Inventors: | David A. Egbers and Steven Jacobs |
| Ser. No.: | 591,102 |

The present invention generally relates an apparatus for mounting a device for determining the position of one or more structures such as sliding doors or windows mounted in tracks, and more particularly relates an apparatus for mounting such a device along the tracks of a laboratory fume hood to enable the position of one or more sash doors that are moveable in associated tracks of a laboratory fume hood to be determined.

Fume hoods are utilized in various laboratory environments for providing a work place where potentially dangerous chemicals are used, with the hoods comprising an enclosure having moveable doors at the front portion thereof which can be opened in various amounts to permit a person to gain access to the interior of the enclosure for the purpose of conducting experiments and the like. The enclosure is typically connected to an exhaust system for removing any noxious fumes so that the person will not be exposed to them while performing work in the hood.

Fume hood controllers which control the flow of air through the fume hood have become more sophisticated in recent years, and are now able to more accurately maintain the desired flow characteristics to efficiently exhaust the fumes from the enclosure as a function of the desired average face velocity of the opening of the fume hood. The average face velocity is generally defined as the flow of air into the fume hood per square foot of open face area of the fume hood, with the size of the open face area being dependent upon the position of one or more moveable sash doors that are provided on the front of the enclosure or fume hood, and in most types of enclosures, the amount of bypass opening that is provided when the door or doors are closed.

The fume hoods are exhausted by an exhaust system that generally include a blower that is capable of being driven at variable speeds to increase or decrease the flow of air from the fume hood to compensate for the varying size of the opening or face. Alternatively, there may be a single blower connected to the exhaust manifold that is in turn connected to the individual ducts of multiple fume hoods, and dampers may be provided in the individual ducts to thereby modulate the flow to maintain the desired average face velocity. There may also be a combination of both of the above described systems.

The doors of such fume hoods can be opened by raising them vertically, often referred to as the sash position, or some fume hoods have a number of doors that are mounted for sliding movement in typically two sets of tracks. There are even doors that can be moved horizontally and vertically, with the tracks being mounted in a frame assembly that is vertically moveable.

The absolute position of vertical doors or the relative positions of horizontal doors is determined by a sensing means which measure the door position and then using a signal proportional to the sensed position varies the speed of the blowers or varies the position of the dampers.

This sensing means can include a switching means which is placed along the track in which the sash doors are moveable. The switching means should be mounted along the track in such a way that it does not interfere with the movement of the sash doors. Prior art mounting means have included a base on which the switching means in secured and adhesive for securing the base to the track.

It is a primary object of the present invention to provide an improved mounting means for securing the switching means along the track.

Another object is to provide an improved mounting means wherein the base and adhesive are as thin as possible to minimize interference with the sash doors, yet still provide protection to the switching means and are sufficiently rigid to allow easy handling.

Another object is to provide such an improved mounting means which is able to withstand exposure to highly corrosive and noxious chemicals, such as methylethylketone (MEK) without detaching from the track or changing in shape by warping.

These and other objects will become apparent upon reading the following detailed description of the present invention, while referring to the attached drawings, in which.

DETAILED DESCRIPTION

Figure 1:
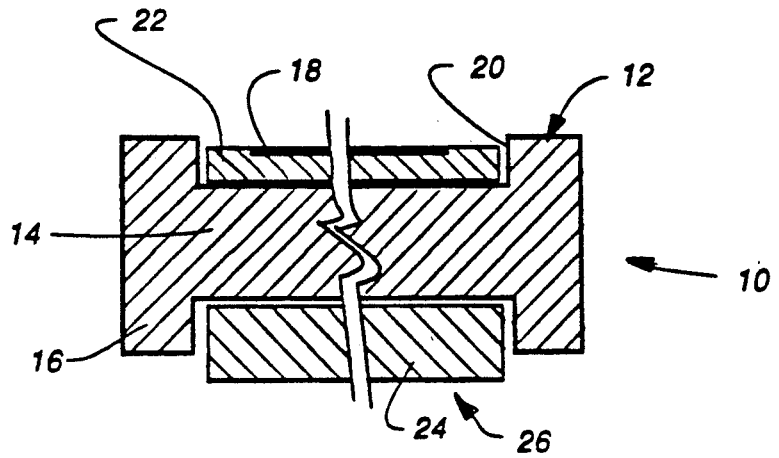
FIG. 1 is a cross sectional view along line 1—1 of FIG. 2 of the apparatus.
Figure 2:
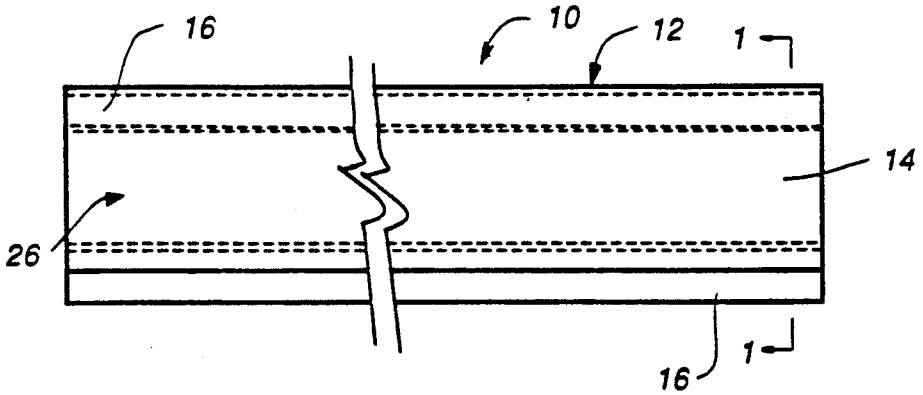
FIG. 2 is a side view of the apparatus embodying the present invention.

It should be generally understood that a fume hood controller controls the flow of air through the fume hood in a manner whereby the effective size of the total opening to the fume hood, including the portion of the opening that is not covered by one or more sash doors, will have a relatively constant average face velocity of air moving into the fume hood. This means that regardless of the area of the uncovered opening, an average volume of air per unit of surface area of the uncovered portion will be moved into the fume hood. This protects the persons in the laboratory from being exposed to noxious fumes or the like because air is always flowing into the fume hood, and out of the exhaust duct, and the flow is preferably controlled at a predetermined rate of approximately 75 to 125 cubic feet per minute per square feet of effective surface area of the uncovered opening. In other words, if the sash door or doors are moved to the maximum open position whereby an operator has the maximum access to the inside of the fume hood for conducting experiments or the like, then the flow of air will most likely have to be increased to maintain the average face velocity at the predetermined desired level.

Many of the controllers for determining the required air flow rely on a sensing means to determine the position of the sash door. One crucial element of this sensing means is the switching means mounted in the track of the sash door.

Broadly stated, the present invention is directed to a mounting means which is adapted to secure the switching means in the track without interfering with the operation of sash door, and which can withstand exposure to the fumes and possible splashes of corrosive and noxious chemicals such as MEK. The invention is not limited to mounting a sensing means to determine the position of fume hood doors, inasmuch as the mounting means may be used with many types of structures that are moveable along a predetermined path. However, the present invention is particularly adapted for use with laboratory fume hoods and the use of corrosive and noxious chemicals therein, where such fume hoods are of the type which have a controller for accurately controlling the flow of air through the fume hood to maintain an average face velocity of air moving into the fume hood. The desired face velocity is a function of the size or area of the openings, which in turn is in part a function of the positions of the sash doors of the fume hood.

Since it is highly desirable for fume hood controller apparatus to provide extremely rapid and effective control of the average face velocity of the fume hood, and to achieve and maintain the desired average face velocity within a few seconds after one or more doors which cover the front opening of the fume hood have been moved, it is necessary that the position of the doors be rapidly and accurately determined. To that end, the present invention provides secure and long-lasting adhesion of the sensing means to the track.

Turning now to the drawings, and particularly FIG. 1, a cross section of the apparatus, indicated generally at 10, shows a base 12 having a generally "I" shaped cross section with a middle portion 14 and two end portions 16. The base 12 can be made of any substance which is able to withstand exposure to the chemicals used in the fume hood. In the preferred embodiment, the base is preferably made of an elongated strip of polyvinylchloride (PVC) since PVC is splash resistant to MEK, one of the most corrosive and noxious solvents used in fume hoods. Another advantage of PVC is that it can be made thin enough to not interfere with the sash door and yet allow easy cutting with a scissors or tin snips. Also, a PVC base is flexible enough to be rolled into a roll for transportation and storage, and is sufficiently strong and rigid to protect the sensing means.

The sensing means 18 is located in a first recess 20 defined by the upper end portions 16 and the middle portion 14 and is secured in the first recess 20 by a first adhesive means 22. The first adhesive means 22 is a double sided high performance acrylic adhesive which is splash resistant to MEK. Although other adhesives may be used, the adhesive used in the preferred embodiment is an acrylic adhesive sold by 3M Corporation under its designations Y4949 or Y4950.

A second adhesive means 24 is located in a second recess 26 defined by the lower end portions 16 of the middle portion 14 of the base 12. The second adhesive means 24 is preferably a high performance acrylic adhesive which is splash resistant to MEK which is applied to both sides of a compressible material. In the preferred embodiment, the acrylic adhesive used for the second adhesive means 24 is also the acrylic adhesive produced by 3M corporation under the designations Y4949 or Y4950, and the compressible material is a closed cell resilient foam which is splash resistant to MEK.

In the preferred embodiment, the height of the end portions 16 of the base 12 is approximately thirteen (13) milli meters. The thickness of the middle portion 14 of the base 12 is approximately seven (7) millimeters. The end portion 16 extend approximately three (3) millimeters from each side of the middle portion 14.

The first adhesive means 22, is approximately two (2) millimeters thick so that the sensing means 18 is located below the top edges of the end portions 16 and is thereby protected by the end portions 16.

The second adhesive means 24 is approximately four and one half (4.5) millimeters thick. When the base 12 is secured in the track by the second adhesive means 24, the compressible material is compressed into the second recess 26, thereby allowing a secure and smooth application of the base 12 to the track even when the surface of the track is rough or uneven.

The device 10 is preferably secured along the entire length of a track (not shown, but see for example, the above cross referenced application, Ser. No. 07/597,102). The exact length needed is measured and cut f rom a roll with a scissors or tin snips. A protective backing is peeled off of the second adhesive means and then the device 10 can be lightly adhesively tacked into place. One feature of the second adhesive means 24 is that it can be removed if only tacked lightly in place. Once the device 10 is properly positioned in the track, the device 10 is pressed securely into place. This pressure fully activates the adhesive properties of the second adhesive means 24 which becomes securely fastened to the track.

While various embodiments of the present invention have been shown and described, it should be understood that various alternatives, substitutions and equivalents can be used, and the present invention should only be limited by th claims and present invention should only be limited by the claims and equivalents thereof.

Various features of the present invention are set forth in the following claims.

What is claimed is:

1. An apparatus for mounting a sensing means in the stationary track of a sliding door or window, the sensing means being adapted to determine the position of the sliding door or window as it moves in the track, said apparatus comprising:

an elongated polyvinylchloride base having a front and a back surface, with a first recess located in said front surface thereof for receiving the sensing means; and a second recess located in said back surface thereof wherein each of said recesses is substantially rectangular, and said base has a generally "I" shaped transverse cross section along its length, said "I" shaped cross section being defined by a middle portion and two end portions, said end portions having two edges, said edges extending transversely in opposite directions from each side of said middle portion;

a first adhesive means for securing the sensing means in said first recess of said base wherein the combined thickness of said first adhesive means and of the sensing means is less than the distance each of said ends extend beyond said middle; and, a second adhesive means located in said second recess for securing said base to the stationary track.

2. An apparatus for mounting a sensing means in a laboratory fume hood having a sliding door, slidable within a track, the sensing means being adapted to sense the position of the door in the track, said apparatus comprising:

an elongated polyvinylchloride base having a front and a back surface, with a first rectangular recess located in said front surface thereof and a second rectangular recess located in said back surface; said recesses causing said base to have a generally "I" shaped transverse cross-section along its length defined by a middle and two end portions;

a first adhesive means for securing the sensing means in said first recess of said base wherein the combined thickness of said first adhesive means and of the sensing means is less than the distance each of said ends extend beyond said middle; and, a second adhesive means, located in said second recess for securing said base to the track of the fume hood.

* * * * *